US006695162B1

(12) United States Patent
Boukobza et al.

(10) Patent No.: US 6,695,162 B1
(45) Date of Patent: Feb. 24, 2004

(54) PLASTIC BOTTLE, HAVING REINFORCING MEANS

(75) Inventors: Michel Boukobza, Le Havre Cedex (FR); Vincent Le Guen, Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 10/048,647

(22) PCT Filed: Jul. 24, 2000

(86) PCT No.: PCT/FR00/02124

§ 371 (c)(1),
(2), (4) Date: Jul. 30, 2002

(87) PCT Pub. No.: WO01/10724

PCT Pub. Date: Feb. 15, 2001

(30) Foreign Application Priority Data

Aug. 6, 1999 (FR) ..... 99 10346

(51) Int. Cl.[7] ..... B65D 1/02

(52) U.S. Cl. ..... 215/384; 215/383; 220/672; 220/675

(58) Field of Search ..... 215/382–384, 215/398; 220/669, 671, 672–675

(56) References Cited

U.S. PATENT DOCUMENTS

D214,973 S * 8/1969 Amand ..... 215/398 X
5,303,834 A * 4/1994 Krishnakumar et al. .... 215/383
5,385,250 A * 1/1995 Pasquale ..... 215/384
5,762,221 A * 6/1998 Tobias et al. ..... 215/381
5,803,290 A 9/1998 Bongiorno
5,908,128 A * 6/1999 Krishnakumar et al. .... 215/381
6,044,997 A * 4/2000 Ogg ..... 215/381
D434,664 S * 12/2000 Bretz et al. ..... D9/520

FOREIGN PATENT DOCUMENTS

EP 0 055 595 A 7/1982
GB 2025889 * 1/1980 ..... 220/672

* cited by examiner

*Primary Examiner*—Sue A. Weaver
(74) *Attorney, Agent, or Firm*—Sughrue Mion, PLLC

(57) ABSTRACT

A plastic bottle, wherein reinforcing portions are formed by a circular groove provided around the body of the bottle. The groove comprises, from the base upwards, a lower part to be connected to the body, a central part, and an upper part to be connected to the body. Each of the parts has a constant peripheral profile, the central part having a peripheral profile with simple curvature with a concave part facing outwards of the bottle, the upper and lower parts having each a profile with simple curvature and a concave part facing inwards of the bottle, and the upper and lower parts are each connected tangentially to the body and the central part. The invention is particularly applicable to bottles designed to be filled with carbonated or aerated drinks.

11 Claims, 1 Drawing Sheet

PLASTIC BOTTLE, HAVING REINFORCING MEANS

BACKGROUND OF THE INVENTION

The purpose of the invention is improvements to plastic bottles having reinforcing means, and which are obtained by blow-molding a plastic blank, either by heat conditioning then blow-molding, or drawing and blow-molding, previously injected preforms, or by extrusion then blow-molding of a parison. It applies most particularly, although not exclusively, to bottles intended to contain gasified beverages, such as carbonated or gaseous beverages.

One known disadvantage of bottles or other containers made of plastic is their propensity to being crushed when held in the hand, primarily after they are opened, causing the contents to be sprayed, especially when they are liquid. This phenomenon is all the more prevalent with thin-walled bottles. The current trend is to reduce the weight of bottles and thus the quantity of material of which they are composed, that is, in order to obtain a bottle of given volume and dimensions, lighter and lighter blanks (preforms or parisons) are being used today.

When the bottles are closed and they contain a non-sparkling product (liquid or other), the risk of crushing when taken in hand is nearly nil; it can, however, undergo a slight deformation that is rarely irreversible. Indeed, in this case the presence of the closing device prevents the variation of the internal volume when it is picked up. At most, a deformation of the wall at constant volume occurs.

When the bottles are closed and they contain a gaseous or gasified product, then not only the risks of crushing related to being taken in hand, but also the risks of deformation when grasped, become nearly nil. Indeed, in this case the gas pressure inside the bottle exerts a force on the inner surface of the wall that resists both the variation in internal volume and the force exerted by the user to hold it, such that the higher the internal pressure the less deformation of the wall.

When it is opened, however, the risk of crushing is all the greater because the user is least expecting it. This is usually the case when the bottle is filled with gaseous or gasified contents. In effect, in this case the user tends to be less careful because when the bottle is closed, the user feels that it is very rigid.

These disadvantages have been partially remedied by making bottles having reinforcing ridges on the periphery of their body. However, this solution is only somewhat satisfactory from a mechanical point of view for non-sparkling contents.

Indeed, 1) when the ridges are large enough to prevent crushing when the bottles are opened, such bottles, when closed and filled with gaseous or gasified contents, tend to be deformed from the effect of the internal pressure by unfolding, even creep at the ridges; or 2) when the ridges are small in size to prevent appreciable deformation due to the internal pressure when the bottles are closed, in this case, upon opening, the ridges are usually not rigid enough to prevent crushing.

Moreover, this solution runs counter to making the bottles lighter, because enough material must be provided to enable to ridges to be made.

U.S. Pat. No. 5,803,290 reveals a bottle having a groove made around the body of the bottle, said groove having a lower part for connection to the body, a central part, and an upper part for connection to the body. By virtue of its profile, the groove provides not a little reinforcement when the bottle is open. However, the structure of the groove is such that there are areas that are susceptible to creep or deformation, particularly from the effect of the internal pressure, when the bottle is closed and filled with a gaseous or gasified product.

BRIEF SUMMARY OF THE INVENTION

A purpose of the invention is to remedy these disadvantages.

According to the invention, a plastic bottle having a body that is cylindrical as generated by rotation, between the bottom of the bottle and the shoulder area, and provided with reinforcing means composed of a groove made around the body of the bottle, said groove having—from bottom to top—a lower part for connection to the body, a central part, and an upper part for connection to the body, each of these parts having a peripheral profile of a constant simple curve, the central part having a peripheral profile with a concavity turned toward the outside of the bottle, the upper and lower parts each having a profile with a concavity turned toward the inside of the bottle, characterized in that the lower part, the central part and the upper part of the groove each have a constant curvature, thus a segmental profile, and in that the upper and lower parts are each connected tangentially to the body and to the central part.

In point of fact, it is the combined profile of the three parts of the groove that makes is possible on the one hand to provide effective protection against crushing upon opening, and on the other hand to prevent the reinforcing means from becoming deformed under the effect of internal pressure; indeed, on the one hand the presence of curved areas tangentially connected to adjacent areas, and on the other hand the existence of peripheral profiles with constant curvature, that is, segmental profiles, means that in the reinforcing means there are no folds or areas susceptible to creep or deformation particularly under the effect of the internal pressure, when the bottle is closed and filled with a gaseous or gasified product, or under the effect of an external force when the bottle is open.

According to another characteristic, the dimensions of the reinforcing means are such that in addition to their reinforcing function, they offer a grip function for the bottle, that is, the user can easily grip the bottle at the groove. For that purpose, the total height of these reinforcing means is preferably between 60 mm and 100 mm, which allows a hand to be positioned therein.

According to another characteristic, the reinforcing means are situated in the upper part of the body. Preferably, then, these means are arranged at or slightly above the center of gravity of the bottle, which further promotes its grip, particularly while they make it possible to provide the above-mentioned gripping function of the bottle. Secondarily, this makes it possible to have, at the lower part of the bottle, an area where a label can be placed.

According to another characteristic, the diameter at the bottom of the groove, that is, at the bottom of the central part, has a value of between 50% and 80% of the maximum diameter of the rest of the body of the bottle, preferably between 60% and 70%. The groove thus has a significant depth that improves the reinforcing effect even more.

According to another characteristic, the upper part and/or the lower part of the groove have a curvature with an average radius of curvature the value of which is between 35% and 55% of the radius of the body of the bottle, and preferably on the order of 40%.

According to another characteristic, the lower part and the upper part of the groove have an identical curvature.

BRIEF DESCRIPTION OF THE DRAWINGS

Other characteristics and advantages of the invention will appear from the description of the appended figures which illustrate, respectively.

DETAILED DESCRIPTION OF THE DRAWINGS

Figure 2:
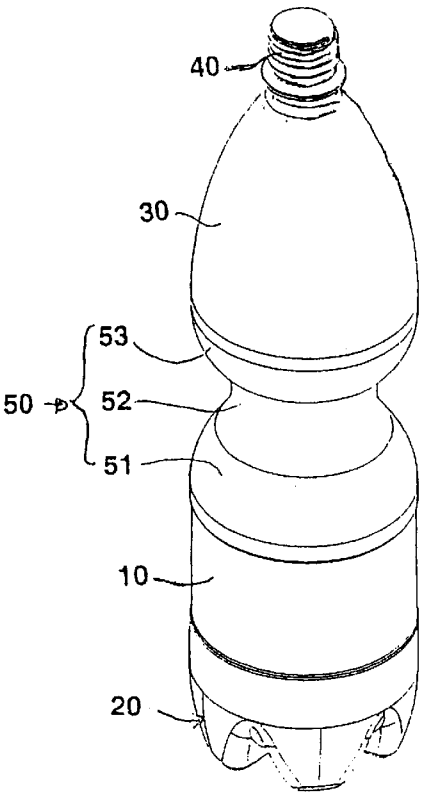
FIG. 2, a slightly tilted view in perspective of the bottle of FIG. 1
Figure 1:
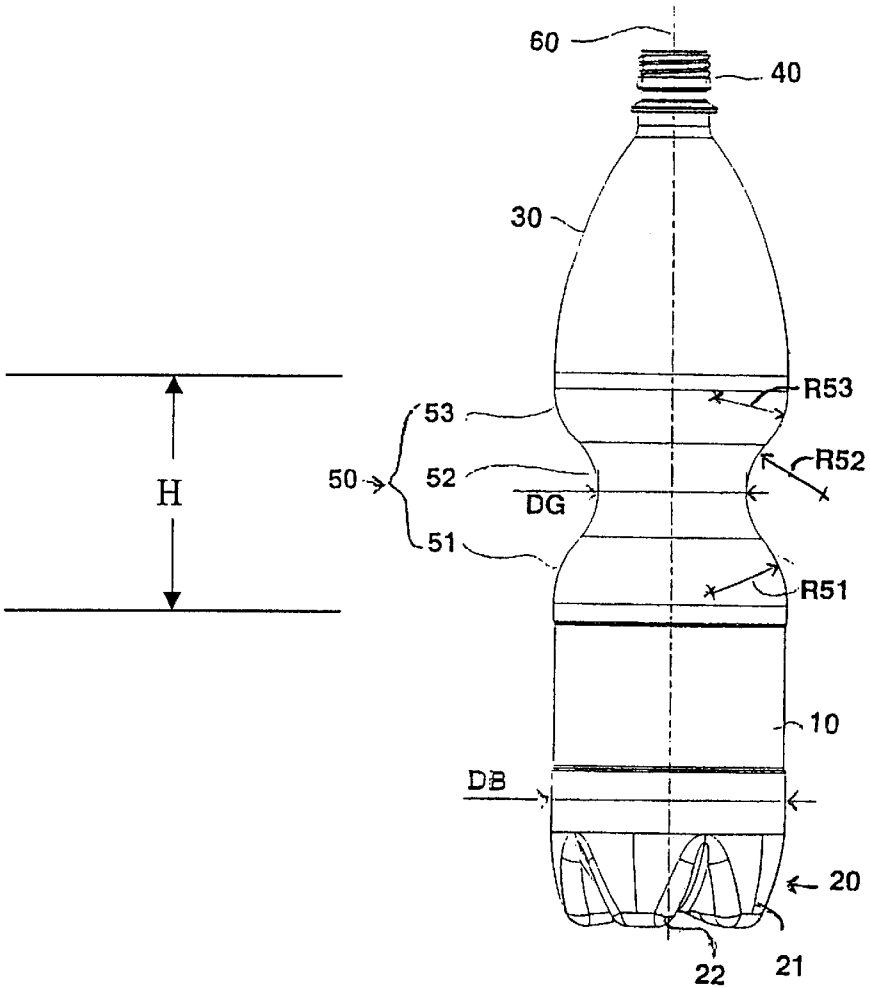
FIG. 1, a view in elevation of one embodiment of a bottle according to the invention.

In FIGS. 1 and 2, a plastic bottle is illustrated that has a body 10, cylindrical as generated by rotation, a bottle bottom 20, in the example represented with petaline feet 21, 22, a shoulder area 30 situated above the body, and finishing at the neck 40 of the bottle.

Throughout the text of the present application, the terms related to a spatial position of the bottle or the various parts of the bodies relative to each other must be understood as for when the bottle is standing, that is, oriented vertically along its longitudinal axis, with the bottom 20 downward and the neck 40 upward. In particular but not exclusively, this is true for the terms above, below, lower, upper, top, bottom, height, vertical, etc.

The bottle is provided with reinforcing means 50 composed of a groove in three parts, a first part 51, lower, a second 52, central or intermediate, and a third 53, upper.

The lower 51 and upper 53 parts provide the connection of the groove to the body of the bottle, on the one hand, and on the other hand each of these parts is connected to the central part 52.

Each of the parts has a constant peripheral profile, that is, if the bottle is rotated around its longitudinal axis 60, the projection of the bottle on a plane parallel to that axis is invariable.

The central part 52 has a peripheral profile with a simple curvature, with a concavity turned toward the outside of the bottle, that is, the central part as such is in the form of a groove.

Preferably, the curvature of the central part is constant, that is, the central part has a segmental profile, or in other terms, in projection on a plane parallel to the longitudinal axis of the bottle, the profile of the central part is determined by a curve with radius R52, the center of curvature of which is at the outside of the bottle, as can be seen in FIG. 1.

The lower 51 and upper 53 parts of the groove also have a peripheral profile with simple curvature, with a concavity turned toward the inside of the bottle, that is, in projection on a plane parallel to the longitudinal axis of the bottle, the direction of curvature of these parts is reversed with respect to that of the central part.

Preferably, the curvature of these parts is constant, that is, they have a segmental profile, or in other terms, in projection on a plane parallel to the longitudinal axis of the bottle, their respective profile is determined by two curves with radius R51 for the lower part, and with radius R53 for the upper part, curves for which the centers of curvature are inside the bottle, as can be seen in FIG. 1.

The lower 51 and upper 53 parts are tangentially connected to the body 10 of the bottle. Moreover, they are tangentially connected to the central part 52, in such a way that there is an inflexure between the central part 52 and each of these two lower 51 and upper 53 parts.

It is the presence of these tangential connections that gives great strength to the reinforcing means.

Preferably, as illustrated, the lower 51 and upper 53 parts have identical or very similar curvatures.

Moreover, it is obvious that, for a non-constant curvature, the mean value of the radius of curvature of these parts should be between 35% and 55% of the radius of the body 10 of the bottle, preferably on the order of 40%.

In addition, it is also obvious that when the lower part 51 and/or upper part 53 have a constant curvature, the respective radii R51 and/or R53 should have values in the same ranges, that is, 35% to 55% of the radius of the body 10, and preferably on the order of 40%.

In other words, the connection of the central part 52 to the body 10 is made by parts having radii of curvatures, average or constant, with relatively high values with respect to that of the body 10.

In a preferred embodiment, the dimensions of the reinforcing means 50 are such that they allow the gripping of the bottle. To that end, in this case, the overall height H of the groove, that is, its dimension parallel to the longitudinal axis of the bottle, taken between the points of tangency of the lower and upper parts with the body, is between 60 mm and 100 mm, and is preferably on the order of 80 mm.

As illustrated, the reinforcing means 50, composed of the groove, are situated in the upper part of the body. This makes it possible not only to provide good reinforcing function, but also allows sufficient space on the lower part to place a label to identify the product contained therein.

Preferably, as illustrated by the figures, the arrangement of the reinforcing means is such that they are also at or slightly above the bottle's center of gravity. This promotes a grip with good balance when the reinforcing means have dimensions that can provide this function.

Tests have shown that, surprisingly, the selection of the relative values of the outside diameter DG of the bottom of the groove and the diameter DB of the body has an appreciable influence on the mechanical strength of the bottle. It was shown that a value of the diameter DG of the bottom of the groove of between 50% and 80% of the value of the diameter DB of the body produced good results, and that the best results obtained were in the range between 60% and 70%.

The bottle according to the invention can be obtained by said methods of injection blow-molding, that is, those methods in which a plastic preform, previously obtained by injection, is heat conditioned, then blow-molded, or alternatively drawn then blow-molded, in a finish mold.

Of course, the invention is not limited to the embodiments described and specifically claimed. It encompasses all of the equivalents thereof available to a person skilled in the art.

What is claimed is:

1. A plastic bottle comprising:

a body (10) that is cylindrical as generated by rotation, between the bottom (20) of the bottle and a shoulder area (30), and provided with reinforcing means (50) composed of a groove made around the body of the bottle, said groove having—from bottom to top—a lower part (51) for connection to the body, a central part (52), and an upper part (53) for connection to the body, each of these parts having a peripheral profile of a constant simple curve, the central part (52) having a peripheral profile with a concavity turned toward the outside of the bottle, the lower (51) and upper (53) parts each having a profile with a concavity turned toward the inside of the bottle, wherein the lower part (51), the central part (52) and the upper part (53) of the groove each have a constant curvature (R51, R52, R53), thus a segmental profile, and wherein the upper and lower parts are each connected tangentially to the body (10) and to the central part (52).

2. The bottle according to claim 1, wherein the dimensions of the reinforcing means (50) are such that in addition to their reinforcing function, they offer a grip function for the bottle.

3. The bottle according to claim 2, wherein the overall height of the reinforcing means (50) is between 60 mm and 100 mm.

4. The bottle according to claim 1, wherein the reinforcing means are disposed in the upper part of the body.

5. The bottle according to claim 4, wherein the reinforcing means (50) are placed at or slightly above the bottle's center of gravity.

6. The bottle according to claim 1, wherein the diameter at the bottom of the groove, that is, at the bottom of the central part (52), has a value of between 50% and 80% of the maximum diameter of the rest of the body of the bottle.

7. The bottle according to claim 6, wherein the diameter at the bottom of the groove has a value of between 60% and 70% of the maximum diameter of the rest of the body of the bottle.

8. The bottle according to claim 1, wherein the lower part (51) and/or the upper part (53) of the groove have a curvature with an average radius of curvature the value of which is between 35% and 55% of the radius of the body of the bottle.

9. The bottle according to claim 8, wherein at least one of the lower part (51) and the upper part (53) of the groove has a curvature with an average radius of curvature the value of which is on the order of 40% of the radius of the body of the bottle.

10. The bottle according to claim 1, wherein the lower part (51) and the upper part (53) of the groove have an identical curvature.

11. The bottle according to claim 1, wherein it is obtained by the injection, heat conditioning, then blow-molding, or alternatively drawing, then blow-molding, of a plastic preform.

* * * * *